US006916203B2

(12) United States Patent
Oyamada et al.

(10) Patent No.: US 6,916,203 B2
(45) Date of Patent: Jul. 12, 2005

(54) WATER-PROOF MODULAR CONNECTOR

(75) Inventors: Takashi Oyamada, Tokyo (JP); Makoto Ueki, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 10/857,317

(22) Filed: May 28, 2004

(65) Prior Publication Data

US 2004/0242067 A1 Dec. 2, 2004

(30) Foreign Application Priority Data

May 30, 2003 (JP) ..... 2003-153616

(51) Int. Cl.[7] ..... H01R 13/40
(52) U.S. Cl. ..... 439/587; 439/263
(58) Field of Search ..... 439/259–264, 439/586–588; 385/135

(56) References Cited

U.S. PATENT DOCUMENTS

| | | | | | |
|---|---|---|---|---|---|
| 4,917,617 | A | * | 4/1990 | Smith | 439/135 |
| 5,299,951 | A | * | 4/1994 | Blaetz | 439/367 |
| 5,580,264 | A | * | 12/1996 | Aoyama et al. | 439/275 |
| 6,595,789 | B2 | * | 7/2003 | Oota et al. | 439/98 |
| 2004/0038588 | A1 | * | 2/2004 | Bernardi et al | 439/587 |
| 2004/0092162 | A1 | * | 5/2004 | Pade | 439/587 |
| 2004/0171302 | A1 | * | 9/2004 | Matkovich et al. | 439/587 |

FOREIGN PATENT DOCUMENTS

| | | |
|---|---|---|
| JP | 8-155025 | 6/1996 |
| JP | 9-129322 | 5/1997 |
| JP | 2001-6798 | 1/2001 |
| JP | 2001-237023 | 8/2001 |
| JP | 2002-313114 | 11/2001 |
| JP | 2002-184516 | 6/2002 |
| JP | 2002-289292 | 10/2002 |

OTHER PUBLICATIONS

Prior Art List prepared by applicants showing the location of the above–listed references in the instant Specification.

* cited by examiner

*Primary Examiner*—Michael C. Zarroli
(74) *Attorney, Agent, or Firm*—Ostrolenk, Faber, Gerb & Soffen, LLP

(57) ABSTRACT

A water-proof modular connector includes a plug socket to be fixed to an object, and a plug detachably coupled to the plug socket. The plug socket includes a plug socket body having first and second socket-openings directing outwardly and inwardly of the object, respectively, a modular jack unit having first and second jack-openings directed in opposite directions to each other, and a holder which holds the modular jack in the plug socket body such that the first and second jack-openings are directed to the first and second socket-openings, respectively. The plug includes a plug body through which a communication cable passes, a modular plug connected to the communication cable, a first positioning unit which positions the modular plug in the plug body, a cap which detachably couples the plug body to the plug socket body such that the modular plug is inserted into the first socket-opening, and a water-proof unit ensuring water-proof between the plug socket body and the plug body.

8 Claims, 4 Drawing Sheets

WATER-PROOF MODULAR CONNECTOR

BACKGROUND OF THE INVENTION

1. Field of the Invention

The invention relates to a water-proof connector, and more particularly to a water-proof modular connector.

2. Description of the Related Art

A connector through which communication cables are connected to each other is necessary to be water-proofed, because a communication unit including the connector, such as a radio-signal base station in a mobile communication system, is often placed outside. A variety of water-proof connectors has been suggested.

For instance, Japanese Patent Application Publication No. 2001-237023 has suggested a coaxial connector having a water-proof structure in which a cylindrical packing is compressed onto an inner wall of a seat by means of a nut.

Japanese Patent Application Publication No. 2001-6798 has suggested a water-proof connector including a male connector housing having a hood, and a female connector housing having an outer piece and an inner piece. The male and female connector housings are hermetically coupled to each other through a water-proof ring assembly to ensure that a room in which a metal terminal is arranged is water-proofed.

Japanese Patent Application Publication No. 9-129322 has suggested a water-proof coaxial connector obtained by adding an O-ring and a water-proof ring to a non-water-proof coaxial connector.

Japanese Patent Application Publication No. 8-155025 has suggested a connector used for medical application, including a pair of connectors one of which has a female thread portion formed in an inner surface, and the other of which a male thread portion to be threaded into the female thread portion.

Japanese Patent Application Publication No. 2002-289292 has suggested a water-proof connector including a water-proof cap in a chamber formed in a connector housing. When the connector housing is engaged to a rear holder, water-proof condition is ensured between a cable and the connector housing. The water-proof cap has a cylindrical seal, a skirt-shaped seal, and a hole through which a cable passes. The connector housing has a recess in which the skirt-shaped seal is accommodated. The rear holder has a cylinder comprised of a first portion which ensures water-proof condition by making close contact with a lip formed on an outer surface of the cylindrical seal, and a second portion which ensures water-proof condition by compressing the skirt-shaped seal onto an inner wall of the recess.

Japanese Patent Application Publication No. 2002-184516 has suggested a water-proof connector through which a connector housing having a rear surface onto which grommet is formed is fit to a second housing such that a bolt passing through the grommet couples the housings to each other. The grommet is formed with a seal making contact with a shank of the bolt. The connector housing has a portion which cooperates with a head of the bolt to sandwich the grommet therebetween. The portion is formed with a recess to which at least a part of the seal can be fit.

Japanese Patent Application Publication No. 2002-313114 has suggested a water-proof connector including a pair of connector housings having cylindrical portions to be fit into each other. A water-proof ring is sandwiched between the cylindrical portions. Each of the connector housings is formed with a pin to be fit into a hole formed in the water-proof ring.

However, these conventional water-proof connectors can be applied to a coaxial connector or a pin connector, but cannot be applied to a modular connector. In a communication cable used in a radio-signal base station usually placed outside, non-water-proof modular connectors are used. Accordingly, it is necessary to surely connect communication cables each including a modular connector, to each other outside for enhancement of safety. In addition, a modular connector is necessary to be water-proofed in order to withstand outside use.

SUMMARY OF THE INVENTION

In view of the above-mentioned problem in the conventional connectors, it is an object of the present invention to provide a water-proof modular connector through which communication cables can be surely connected to each other in water-proof condition.

Hereinbelow is described a water-proof modular connector in accordance with the present invention through the use of reference numerals used in later described embodiments. The reference numerals are indicated only for the purpose of clearly showing correspondence between claims and the embodiments. It should be noted that the reference numerals are not allowed to use in the interpretation of claims of the present application.

There is provided a water-proof modular connector, including a plug socket (100) to be fixed to an object (2) such as a communication device, and a plug (200) detachably coupled to the plug socket (100), wherein the plug socket (100) includes a plug socket body (1) having a first socket-opening (11A) directing outwardly of the object (2) and a second socket-opening (11B) directing inwardly of the object (2), a modular jack unit (17) having first and second jack-openings into which communication cables (23, 101) are inserted, the first and second jack-openings being directed in opposite directions to each other, and the plug (200) includes a plug body (21) through which a communication cable (23) passes, a modular plug (24) connected to the communication cable (23) at an end of the communication cable (23), a first positioning unit (28, 29) which holds the modular plug (24) at a certain position in the plug body (21), a cap (31) which detachably couples the plug body (21) to the plug socket body (1) at the first socket-opening (11A) such that the modular plug (24) is inserted into the first socket-opening (11A) in water-proof condition, and a water-proof unit ensuring water-proof between the plug socket body (1) and the plug body (21).

The plug socket (100) may further include and a holder (18) which holds the modular jack unit (17) in the plug socket body (1) such that the first jack-opening is directed to the first socket-opening (11A) and the second jack-opening is directed to the second socket-opening (11B).

For instance, the cap (31) is threaded in an inner surface thereof and the plug socket body (1) is threaded in an outer surface thereof such that the cap (31) and the plug socket boy (1) are detachably coupled to each other.

For instance, the modular jack unit (17) is comprised of a first modular jack (14) having the first jack-opening, a second modular jack (15) having the second jack-opening, and a substrate (16) on which the first and second modular jacks (14, 15) are mounted such that the first and second jack-openings are directed oppositely to each other and the first and second modular jacks (14, 15) are electrically connected to each other.

It is preferable that the plug socket body (1) has a flange (5) radially outwardly extending between the first and second socket-openings (11A, 11B), and the plug socket body (1) is fixed to the object (2) by being inserted into an opening of the object (2), and threading the flange (5) onto the object (2).

It is preferable that the plug socket body (1) includes a first positioning unit (9, 18, 20) which positions the modular jack unit (17) at a predetermined position in plug socket body (1).

For instance, the water-proof unit is comprised of an O-ring (30), the cap (31) coupling the plug body (21) to the plug socket body (1) with the O-ring (30) sandwiched between the plug body (21) and the plug socket body (1).

It is preferable the cap (31) is arranged around the plug body (21) in rotatable condition, in which case, the modular connector preferably further includes a stopper ring (33) arranged on an outer surface of the plug body (21) so as to prevent the cap (31) from dropping off the plug body (21).

The advantages obtained by the aforementioned present invention will be described hereinbelow.

In accordance with the present invention, it is possible to readily and surely attach a modular connector to and detach the modular connector from a communication device only in an area outside of the communication device, and further possible to ensure water-proof condition between the modular connector and the communication device merely by fastening the cap to the plug socket body of the plug socket.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

As mentioned later, a water-proof modular connector in accordance with the embodiment of the present invention is comprised of a plug socket 100 to be fixed to a communication device 2, and a plug 200 detachably coupled to the plug socket 100.

Figure 1:
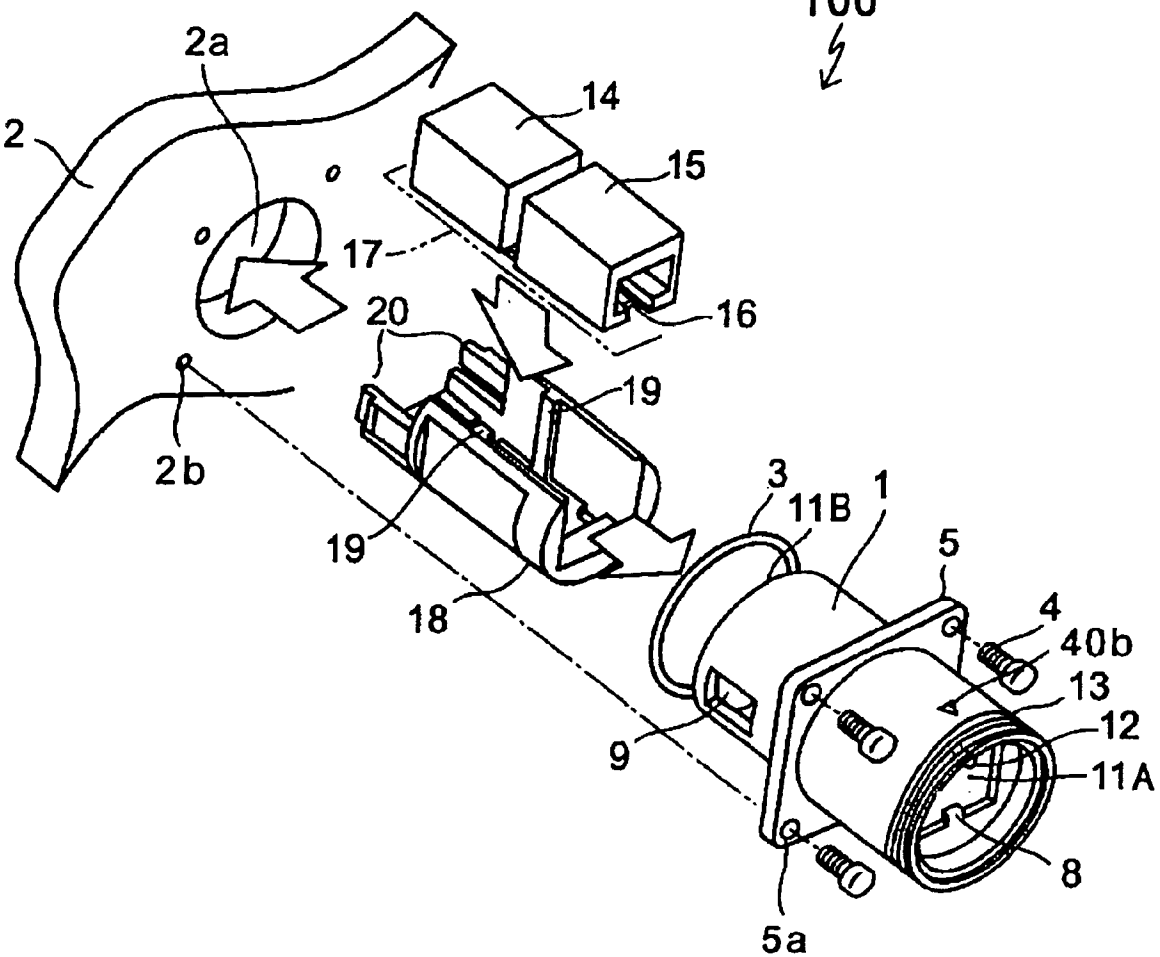
FIG. 1 is an exploded perspective view of the plug socket in the water-proof modular connector in accordance with a preferred embodiment of the present invention.

FIG. 1 is an exploded perspective view of the plug socket 100.

As illustrated in FIG. 1, the plug socket 100 is comprised of a plug socket body 1, a modular jack unit 17, and a modular jack holder 18.

The plug socket body 1 is cylindrical, and has a first socket-opening 11A directing outwardly of the communication device 2 and a second socket-opening 11B directing inwardly of the communication device 2 when the plug socket body 1 is fixedly inserted into a through-hole 2*a* of the communication device 2.

The plug socket body 1 is formed at an outer surface thereof with a square flange 5 radially outwardly extending between the first and second socket-openings 11A and 11B. The flange 5 is formed at corners thereof with through-holes 5*a*. The communication device 2 is formed with a through-hole 2*a* having a diameter equal to a diameter of the plug socket body 1, and further formed with threaded-holes 2*b* around the through-hole 2*a*. The plug socket body 1 is fixed to the communication device 2 by inserting the plug socket body 1 into the through-hole 2*a*, and threading screws 4 into the threaded-holes 2*b* through the through-holes 5*a*. When the plug socket body 1 is inserted into the through-hole 2*a*, an O-ring 3 is sandwiched between the flange 5 and the communication device 2.

The modular jack holder 18 composed of electrical insulator such as plastics and holding the modular jack unit 17 is incorporated in the plug socket body 1. The modular jack holder 18 is formed at an end thereof with claws 20. The plug socket body 1 is formed at a sidewall thereof with openings 9. When the modular jack holder 18 is inserted into the plug socket body 1, the claws 20 are fit into the openings 9 to prevent the modular jack unit 18 from peeling off the plug socket body 1.

The plug socket body 1 is formed at an inner wall there of at the first socket-opening 11A with a first rib 8, and further formed at an inner wall in the vicinity of the first socket-opening 11A with a second rib 12 for ensuring the plug 200 to be properly inserted into the plug socket body 1. The first and second ribs 8 and 12 position the modular jack unit 17 in a predetermined position when the modular jack holder 18 holding the modular jack unit 17 is inserted into the plug socket body 1.

The modular jack unit 17 is comprised of a first modular jack 14 having a first jack-opening, a second modular jack 15 having a second jack-opening, and a substrate 16 on which the first and second modular jacks 14 and 15 are mounted such that the first and second jack-openings are directed oppositely to each other and the first and second modular jacks 14 and 15 are electrically connected to each other. Specifically, the first jack-opening of the first modular jack 14 is directed to the second socket-opening 11B, and the second jack-opening of the second modular jack 15 is directed to the first socket-opening 11A. As mentioned later, into the first and second jack-openings are inserted communication cables.

The modular jack unit 17 is held in a predetermined position in the modular jack holder 18 by means of positioning claws 19 fitting into a space formed between the first and second modular jacks 14 and 15.

When the modular jack holder 18 is inserted into the plug socket body 1, the modular jack unit 17 is fixed in a predetermined position and in a predetermined direction in the plug socket body 1. Thus, the second jack-opening 15 is exposed through the first socket-opening 11A, and the first jack-opening 14 is exposed through the second socket-opening 11B, and hence, exposed to an inside of the communication device 2.

The plug socket body 1 is formed at an outer surface thereof around the first socket-opening 11A with a threaded portion 13 to which the plug 200 is fastened.

Figure 2:
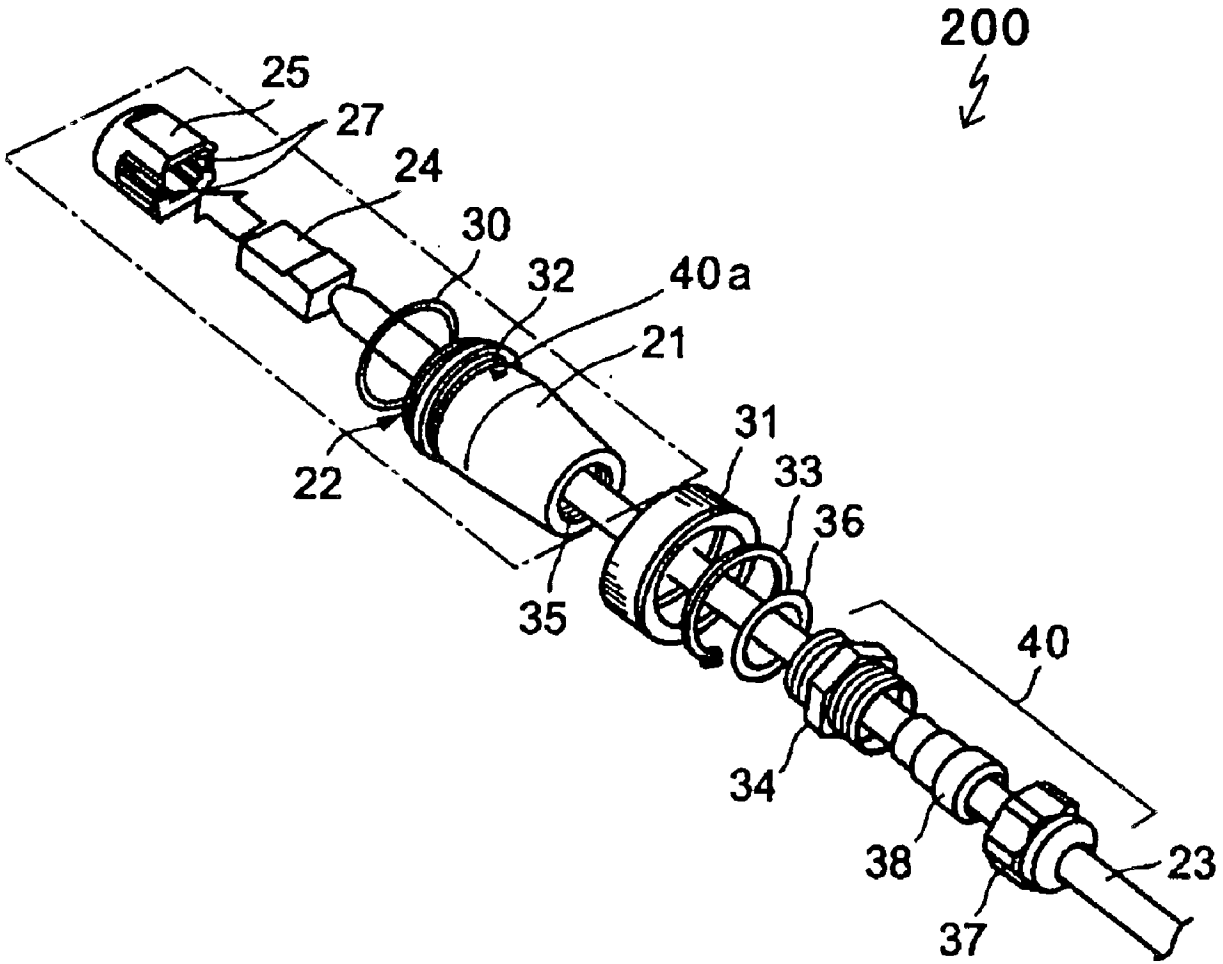
FIG. 2 is an exploded perspective view of the plug in the water-proof modular connector in accordance with a preferred embodiment of the present invention.
Figure 3A:
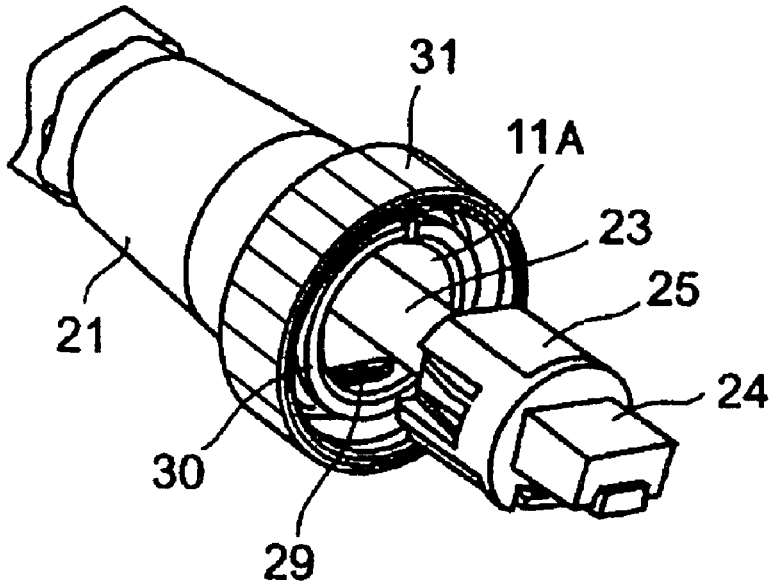
FIG. 3A is an upper perspective view of the plug in the water-proof modular connector.

FIG. 2 is an exploded perspective view of the plug 200. FIG. 3A is an upper perspective view of the plug 200, and FIG. 3B is a lower perspective view of the plug 200.

As illustrated in FIG. 2, the plug 200 is comprised of a cylindrical plug body 21, a modular plug 24, a plug holder 25, a cap 31, and a water-proof unit 40.

Through the plug body 21 passes a communication cable 23. The modular plug 24 is fixedly connected to an end of the communication cable 23, and is held in the plug holder 25 by being inserted into the plug holder 25. The plug holder 25 is positioned at an end 22 of the plug body 21.

Figure 3B:
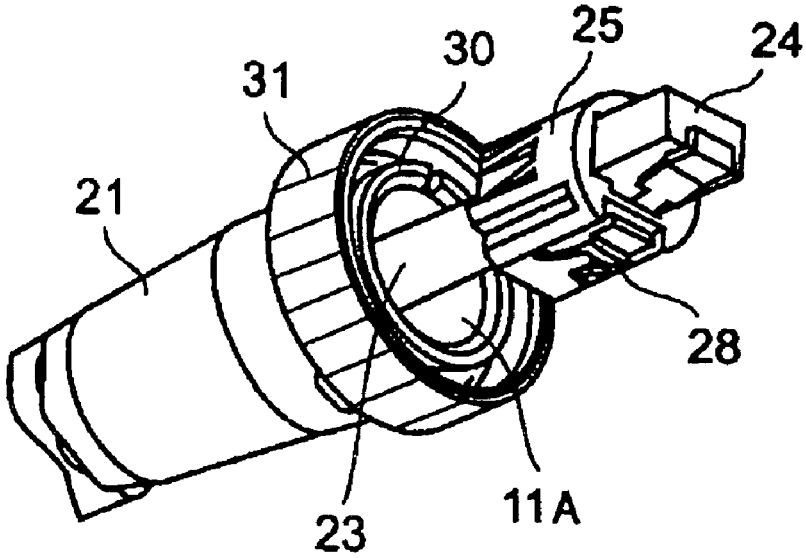
FIG. 3B is a lower perspective view of the plug in the water-proof modular connector.

As illustrated in FIG. 3B, the plug holder 25 is formed at a lower surface thereof with a lock unit 28 for locking the modular plug 24. When the plug holder 25 is inserted into the plug body 21, a projection 29 formed on an inner wall of the plug body 21 pushes the lock unit 28 up with the result that the lock unit 28 locks the modular plug 24 in a predetermined position in the plug holder 25 and further in the plug body 21.

Around the plug body 21 is arranged the cap 31 in rotatable condition. The plug body 21 is formed with a slit 32, into which a C-shaped retainer 33 is fit. The retainer 33 acts as a stopper for preventing the cap 31 from dropping off the plug body 21.

The cap 31 is formed at an inner surface thereof with a threaded portion to be threaded into the threaded portion 13 of the plug socket body 1. Hence, the cap 31 detachably couples the plug body 21 to the plug socket body 1 through the first socket-opening 11A such that the modular plug 24 is inserted into the first socket-opening 11A in water-proof condition.

The plug body 21 is formed at an inner surface thereof at end thereof with a threaded portion 35.

The water-proof unit 40 is comprised of a first water-proof cable clamp 34 to be threaded into the threaded portion 35 of the plug body 21 with an O-ring 36 being sandwiched therebetween, a bush 38 composed of resilient material, and a second water-proof cable clamp 37.

The second water-proof cable clamp 37 is threaded to a threaded portion formed on an outer surface of the first water-proof cable clamp 34, with the bush 38 being sandwiched therebetween, ensuring that the communication cable 23 is fastened by the bush 38 for accomplishing water-proof condition between the communication cable 23 and the plug body 21. A commercially available water-proof unit may be used as the water-proof unit 40.

Figure 4:
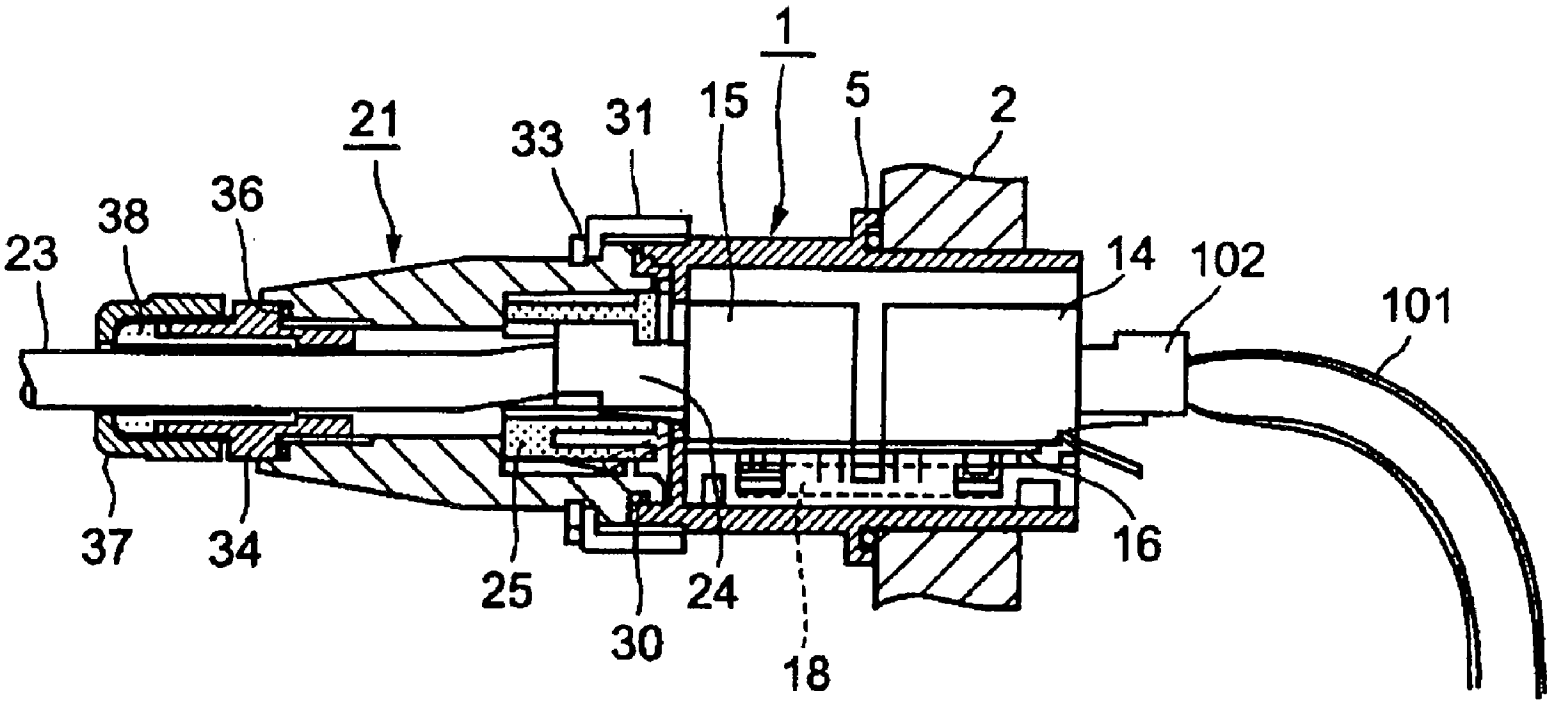
FIG. 4 is a longitudinal cross-sectional view of the water-proof modular connector.

FIG. 4 is a longitudinal cross-sectional view of the modular connector fixed to the communication device 2.

As mentioned above, the modular jack unit 17 is fixed at a predetermined position in a predetermined direction in the plug socket body 1, and the first and second jack-openings of the first and second modular jacks 14 and 15 are exposed through the second and first socket-opening 11B and 11A, respectively. The plug body 21 into which the plug holder 25 has been inserted is inserted into the plug socket body 1 through the first socket-opening 11A such that an alignment mark 40*a* of the plug body 21 aligns with an alignment mark 40*b* of the plug socket body 1. Thus, the modular plug 24 is inserted into the second modular jack 15 through the second jack-opening in the plug socket body 1.

Then, the cap 31 is threaded into the threaded portion 13 of the plug socket body 1 with an O-ring 30 being sandwiched between the plug body 21 and the plug socket body 1. Thus, water-proof condition is ensured between the plug body 21 and the plug socket body 1.

A modular plug 102 connected to an end of a communication cable 101 is inserted into the first modular jack 14 through a wall of the communication device 2 from inside of the communication device 2. Since the first and second modular jacks 14 and 15 are electrically connected to each other through the substrate 16, the external communication cable 23 inserted into the second modular jack 15 and the internal communication cable 101 inserted into the first modular jack 14 are electrically connected to each other through the first and second modular jacks 14 and 15.

When the external communication cable 23 is taken out of the modular connector, the cap 31 is released from the threaded portion 13 of the plug socket body 1, and then, the plug socket body 21 is taken off the plug body 1. Then, the modular plug 24 is released from the second modular jack 15.

In the above-mentioned embodiment, two separate modular jacks, specifically, the first and second modular jacks 14 and 15 are electrically connected to each other through the substrate 16. As an alternative, a single modular jack having two openings directed oppositely to each other may be used in place of the first and second modular jacks 14 and 15.

In the above-mentioned embodiment, the cap 31 is coupled to the plug socket body 1 in threaded condition. The cap 31 may be coupled to the plug socket body 1 in any means other than threading.

Though the water-proof connector in accordance with the above-mentioned embodiment is designed to include the modular jack holder 18 for holding the modular jack unit 17 therein, the water-proof connector may be designed not to include the modular jack holder 18, in which case, the modular jack unit 17 is fixed directly to and in the plug socket body 1 such that the first jack-opening of the first modular jack 14 is exposed through the second socket-opening 11B and the second jack-opening of the second modular jack 15 is exposed through the first socket-opening 11B.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2003-153616 filed on May 30, 2003 including specification, claims, drawings and summary is incorporated herein by reference in its entirety.

What is claimed is:

1. A water-proof modular connector, comprising a plug socket to be fixed to an object, and a plug detachably coupled to said plug socket, wherein said plug socket includes:

a plug socket body having a first socket-opening directing outwardly of said object and a second socket-opening directing inwardly of said object; and a modular jack unit having first and second jack-openings into which communication cables are inserted, said first and second jack-openings being directed in opposite directions to each other; and said plug includes:

a plug body through which a communication cable passes;

a modular plug connected to said communication cable at an end of said communication cable;

a first positioning unit which holds said modular plug at a certain position in said plug body;

a cap which detachably couples said plug body to said plug socket body at said first socket-opening such that said modular plug is inserted into said first socket-opening in water-proof condition; and a water-proof unit ensuring water-proof between said plug socket body and said plug body.

2. The water-proof modular connector as set forth in claim 1, wherein said plug socket further includes a holder which holds said modular jack unit in said plug socket body such that said first jack-opening is directed to said first socket-opening and said second jack-opening is directed to said second socket-opening.

3. The water-proof modular connector as set forth in claim 1, wherein said cap is threaded in an inner surface thereof and said plug socket body is threaded in an outer surface thereof such that said cap and said plug socket body are detachably coupled to each other.

4. The water-proof modular connector as set forth in claim 1, wherein said modular jack unit is comprised of a first modular jack having said first jack-opening, a second modular jack having said second jack-opening, and a substrate on which said first and second modular jacks are mounted such that said first and second jack-openings are directed oppositely to each other and said first and second modular jacks are electrically connected to each other.

5. The water-proof modular connector as set forth in claim 1, wherein said plug socket body has a flange radially outwardly extending between said first and second socket-openings, and said plug socket body is fixed to said object by being inserted into an opening of said object, and threading said flange onto said object.

6. The water-proof modular connector as set forth in claim 1, wherein said plug socket body includes a first positioning unit which positions said modular jack unit at a predetermined position in plug socket body.

7. The water-proof modular connector as set forth in claim 1, wherein said water-proof unit is comprised of an O-ring, said cap coupling said plug body to said plug socket body with said O-ring sandwiched between said plug body and said plug socket body.

8. The water-proof modular-connector as set forth in claim 1, wherein said cap is arranged around said plug body in rotatable condition, and further comprising a stopper ring arranged on an outer surface of said plug body so as to prevent said cap from dropping off said plug body.

* * * * *